United States Patent [19]

Grasso

[11] 4,206,875

[45] Jun. 10, 1980

[54] HEAT RECOVERY APPARATUS

[75] Inventor: Giacomo Grasso, Moncalieri, Italy

[73] Assignee: Fiat Societa per Azigni, Turin, Italy

[21] Appl. No.: 940,236

[22] Filed: Sep. 7, 1978

[30] Foreign Application Priority Data

Sep. 27, 1977 [IT] Italy ..... 69122 A/77

[51] Int. Cl.[2] ..... F24B 7/04

[52] U.S. Cl. ..... 237/55; 110/326; 122/20 B; 122/DIG. 1; 165/DIG. 2

[58] Field of Search ..... 122/20 B, DIG. 1, 155 A; 165/DIG. 2; 237/55; 110/323, 326; 431/215

[56] References Cited

U.S. PATENT DOCUMENTS

| | | | |
|---|---|---|---|
| 2,348,901 | 5/1944 | Handley | 110/323 |
| 3,736,961 | 6/1973 | Walsh | 110/326 |
| 4,098,325 | 7/1978 | Scheel | 165/DIG. 2 |
| 4,113,009 | 9/1978 | Meyer et al. | 110/326 |
| 4,147,303 | 4/1979 | Talucci | 165/DIG. 2 |

*Primary Examiner*—Edward G. Favors

*Attorney, Agent, or Firm*—Sughrue, Rothwell, Mion, Zinn and Macpeak

[57] ABSTRACT

A recuperator for recovering heat from hot exhaust gases flowing through a flue comprises inner and outer cylindrical walls coaxially surrounding a portion of the flue to which a plurality of fins are fixed, the fins extending longitudinally of the flue and being grouped such that fins spaced circumferentially around one section of the flue are angularly staggered with respect to fins spaced circumferentially around an adjacent section of the flue, the recuperator being arranged such that cold gas can be passed into, and is preheated as it flows along, an outer annular space between the said walls, the gas passing into an inner annular space containing the fins which cause turbulence and increase the heat-transfer by convection and radiation to the gas, and the heated gas being emitted through an outlet.

1 Claim, 2 Drawing Figures

HEAT RECOVERY APPARATUS

Figure 1:
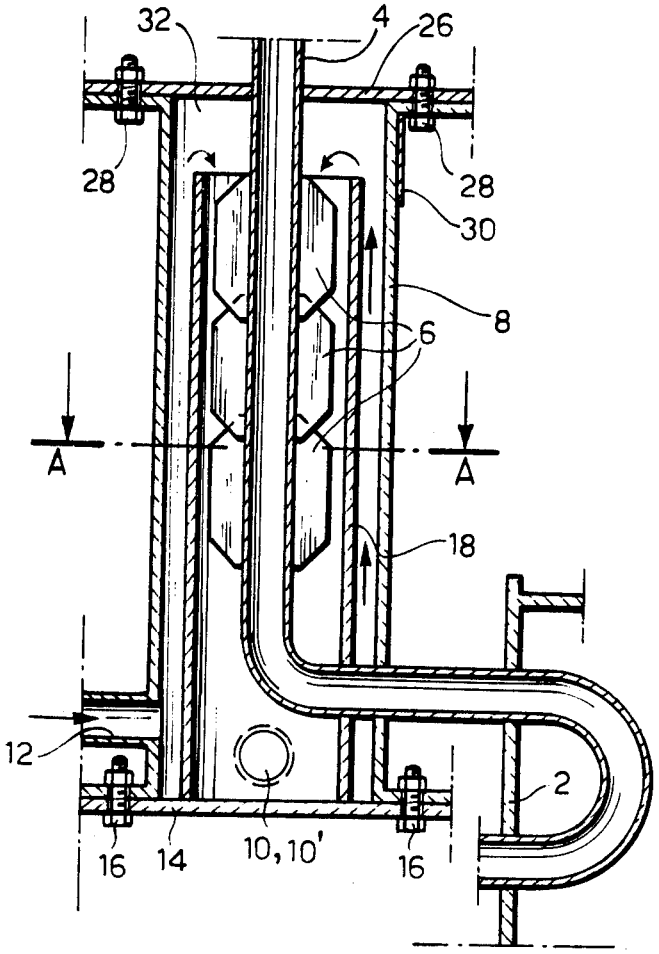

The present invention relates to heat-recovery apparatus for recovering heat from exhaust gases, and particularly to a recuperator which is suitable for use in conjunction with furnace flues having a limited throughput of gas, such as those associated with the iron and steel industries.

In recent years, interest in the recovery of heat from exhaust gases which are emitted directly into the atmosphere at high temperatures has been increasing due to the ever increasing cost of fuels but at present there are no known recovery systems which are suitable for recovering heat from exhaust gases in flues having a limited through-put of air.

In furnace installations having flues with considerable height and cross-sectional dimensions, heat recoverers are usually arranged in the exhaust ports of the flues since, given the high throughput and the strong turbulence of the waste gases, the influence of the recoverers on the discharge characteristics of the chimneys, and hence on the furnace process and the characteristics of the combustion, is negligible, or at least leads to losses which are acceptable in view of the economic advantages obtained by recovering heat from the exhaust gases, the recovered heat usually being used to preheat combustion air for the furnace. In furnaces or heat-treatment installations, such as those used in the iron and steel industries, which have a limited throughput of gas with minimal turbulence (that is a gas flow with a Reynolds number which is low or considerably below the critical value), and relatively high exhaust gas temperatures associated with chimneys of restricted height and cross-sectional dimensions, the use of a conventional heat-recovery system upsets the discharge characteristics of the chimney to such an extent that the consequential change in the operating conditions of the furnace is unacceptable.

The object of the present invention is, therefore, to provide a heat recuperator which can be used in conjunction with a flue having a limited throughput of gas without affecting the characteristics of the associated furnace or thermal treatment installation to an unacceptable degree, but the use of which results in a high heat-exchange ratio even in the case of a flow of exhaust gas which has an extremely low Reynolds number or one which is considerably less than the critical value.

According to the present invention there is provided a recuperator for recovering heat from hot exhaust gases flowing through a flue, including inner and outer cylindrical walls surrounding the flue, an inlet to an outer annular space between the walls and an adjacent outlet from an inner annular space between the inner wall and the flue, the annular spaces being in communication at their ends remote from the inlet and outlet such that gas to be heated in the recuperator introduced through the inlet, flows along the outer annular space and into and along the inner annular space to the outlet, the recuperator being characterised in that it includes a plurality of fins fixed to, and extending longitudinally of, the flue within the inner annular space, the fins spaced circumferentially around one section of the flue being angularly staggered with respect to fins spaced circumferentially around an adjacent section of the flue.

In use of the system described, thermal transmission takes place largely by radiation from the hot gases, in contradistinction to recovery systems at present on the market which rely to a greater extent on convection. This factor provides a further advantage of the present invention in that the temperature at least at the cylindrical heat exchange walls is relatively low so that these can be made from ordinary carbon steels rather than from special alloys, thus reducing the cost of the recuperator.

Figure 2:
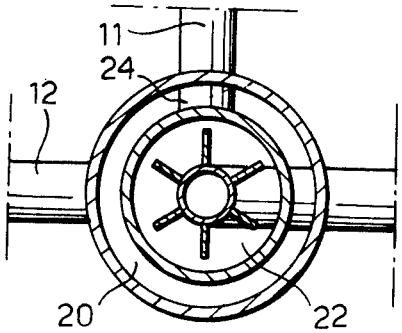

One embodiment of a recuperator according to the present invention will now be described by way of example, with reference to the accompanying drawings in which:

FIG. 1 is a longitudinal sectional view of a heat-recuperator and according to the invention, FIG. 2 is a cross-sectional view taken on line A—A of FIG. 1.

Referring to the drawings a vertical wall 2 of a furnace is shown schematically with a discharge flue 4 of the furance issuing horizontally therefrom. The flue 4 has a vertical section coaxially surrounded by outer and inner cylindrical walls 8, 18 respectively, enclosing an outer annular chamber 20 between the walls 8, 18 and an inner annular chamber 22 between the wall 18 and the flue 4. The horizontal section of the flue 4 passes through corresponding, respective openings in the walls 8, 18 to which it is sealed.

The lower ends of the chambers 20, 22 are closed by a plate 14 rigidly fixed to an outwardly projecting flange of the wall 8 by means of a plurality of bolts 16. The lower end of the wall 18 rests on, and is sealed to, the plate 14.

The upper opening of the cylindrical wall 8 is closed by a plate 26 fixed to an outwardly projecting flange of the wall 8 by a plurality of bolts 28, the plate 26 having a central sealed opening through which the chimney 4 passes.

The upper end of the inner wall 18 is, however, spaced below the plate 26, providing an enlarged annular space 32 allowing communication between the chambers 20, 22.

The outer wall 8 is provided adjacent its lower end with an inlet opening to which is sealed a tube 12 through which cold gas to be heated in the recuperator can be passed into the outer annular chamber 20. Also provided at the lower end of the recuperator is an outlet opening 10' in the wall 18; the opening 10' is connected to an opening 10 in the outer wall 8 by a length of tube 24, a further tube 11 being sealed to the outer surface of the wall 8 around the opening 10 to conduct hot gases from the chamber 22.

The recuperator further includes a plurality of fins 6 fixed to the flue 4 within the chamber 22 and extending longitudinally of the flue. The fins 6 are arranged in three groups spaced along the flue the fins in each group being circumferentially spaced around the flue 4 but angularly staggered with respect to the fins of an adjacent group.

In use of the recuperator described above hot exhaust gases from the furnace escape through the flue 4 and cold air, to be pre-heated prior to use in the furnace, is drawn from the atmosphere and passes through a ventilator, not shown in the drawings, into the chamber 20 via the tube 12. In the lower part of the chamber 20 the air undergoes an initial pre-heating, the inner cylindrical wall 18 being at a higher temperature than the air. The air then rises up the entire length of the chamber 20 into the annular space 32 from which it is forced into the chamber 22. Here the air comes into contact with the hot walls of flue 4 and the fins 6, heat transfer taking place both by radiation and convection; the turbulence of the air is also increased favouring the heat exchange. The air finally flows out from the lower part of the chamber 22 through the openings 10, 10' and tubes 24, 11 to be introduced into the burner (not shown in the drawings) of the furnace. The air temperature may be increased to values of about 360° to 400° C.

The arrangement and the dimensions of the fins depend on the particular installation with which they are to be used, calculations being based on the value of the ratio L/D, where L is the length of the flue and D is its diameter, on the temperature of the hot exhaust gases, the amount of heat which it is desired to recover from the said gases and on the pressure of the air feed.

The recuperator described above has an outer jacket 30 of heat insulating material, only part of which is shown, to reduce heat losses.

What is claimed is:

1. A recuperator for recovering heat from hot exhaust gases flowing through a flue; including an inner and an outer cylindrical wall surrounding said flue, said walls defining between them an outer annular space and said inner wall and said flue defining between them an inner cylindrical space; said outer wall having inlet means to said outer annular space and said inner wall having outlet means from said inner annular space adjacent said inlet means; and means defining a passage between said annular spaces at their ends remote from said inlet means and said outlet means, whereby gas to be heated in the system introduced through said inlet means flows along said outer annular space to said outlet means and wherein;

said flue within said inner annular space is divided into a plurality of sections; and said recuperator further includes a plurality of groups of radial fins, each of said fins being fixed to, and extending longitudinally of said flue within said inner annular space, the fins of each of said groups being spaced circumferentially around a respective section of said plurality of sections of said flue and being angularly staggered with respect to the fins of an adjacent said group of fins.

* * * * *